United States Patent [19]

Loose

[11] 4,370,529

[45] Jan. 25, 1983

[54] SWITCH HAVING SWITCH CONTACTS ENGAGEABLE DIRECTLY WITH CIRCUIT BOARD CONTACTS

[75] Inventor: Winfield W. Loose, Linglestown, Pa.

[73] Assignee: AMP Incorporated, Harrisburg, Pa.

[21] Appl. No.: 321,880

[22] Filed: Nov. 16, 1981

[51] Int. Cl.[3] ..... H01H 15/00; H01H 9/20

[52] U.S. Cl. ..... 200/16 D; 200/5 R; 200/307; 200/328

[58] Field of Search .... 200/1 R, 5 R, 6 R, 6 B–6 BB, 200/16 R, 16 C, 16 D, 290, 292, 303, 307, 328

[56] References Cited

U.S. PATENT DOCUMENTS

| | | | |
|---|---|---|---|
| 3,783,204 | 1/1974 | Kennedy | 200/16 D X |
| 3,886,341 | 5/1975 | Forrest | 200/328 |
| 3,919,505 | 11/1975 | Becker et al. | 200/328 X |
| 4,029,914 | 6/1977 | Schmidt et al. | 200/292 X |
| 4,057,520 | 11/1977 | Schwartz | 200/292 X |
| 4,070,555 | 1/1978 | Carli | 200/6 B |
| 4,190,749 | 2/1980 | Erickson et al. | 200/307 |
| 4,316,067 | 2/1982 | Whiteman, Jr. | 200/159 A |

*Primary Examiner*—J. R. Scott

*Attorney, Agent, or Firm*—Katherine A. Nelson; Frederick W. Raring

[57] ABSTRACT

A miniature switching device, intended for mounting on a circuit board, is disclosed comprising a housing, having at least one switch cavity therein. Each switch cavity has therein an actuator and a spring contact member. When the switch is mounted on a circuit board, the spring contacts are directly engageable with fixed contact points on a circuit board. The switch has multiple, as well as single, function capability.

12 Claims, 9 Drawing Figures

SWITCH HAVING SWITCH CONTACTS ENGAGEABLE DIRECTLY WITH CIRCUIT BOARD CONTACTS

FIELD OF THE INVENTION

This invention relates to high density switching devices of the type that are mounted on circuit boards for switching circuit board conductors.

BACKGROUND OF THE INVENTION

There is an increasing need for circuit board components that have a minimum number of parts and reduced costs of production. Application Ser. No. 135,815, filed Mar. 31, 1980, now U.S. Pat. No. 4,316,067, which discloses a slide switch that has a housing, a slide member and contact members that are directly engageable with fixed circuit board contacts is one example. When multiple switches are required, however, space considerations make it impractical to mount several such slide switch units adjacent to each other. The present invention provides a multi-unit switch that is compact and has a minimum number of parts. A switch in accordance with the invention can be used in situations where dual in-line package (DIP) switches are used such as the DIP switch shown in U.S. Pat. No. 3,999,287. A switch module in accordance with the invention is competitive in price with and is smaller in overall size than a DIP switch having the same switching capability.

The present invention is directed to the achievement of a high density miniature switching device intended for circuit board use having a substantially reduced number of component parts and having spring contacts therein which are directly engageable with fixed contact points on the circuit board. The invention is further directed to the achievement of providing multiple, as well as single, function capability. Assembly of the switch to the circuit board does not require soldering but rather can be achieved by the means of mounting feet integral with the switch housing.

A preferred form of the switch module in accordance with the invention comprises a generally prismatic insulating housing having a plurality of switch cavities therein; each cavity having an essentially U-shaped spring contact member and an actuator, therein. The spring contact members can be produced in strip form. The actuator, molded of insulating material, is retained in the housing by the spring contact member. The assembled module is mounted on the foil side of the circuit board.

PREFERRED EMBODIMENT

Figure 1:
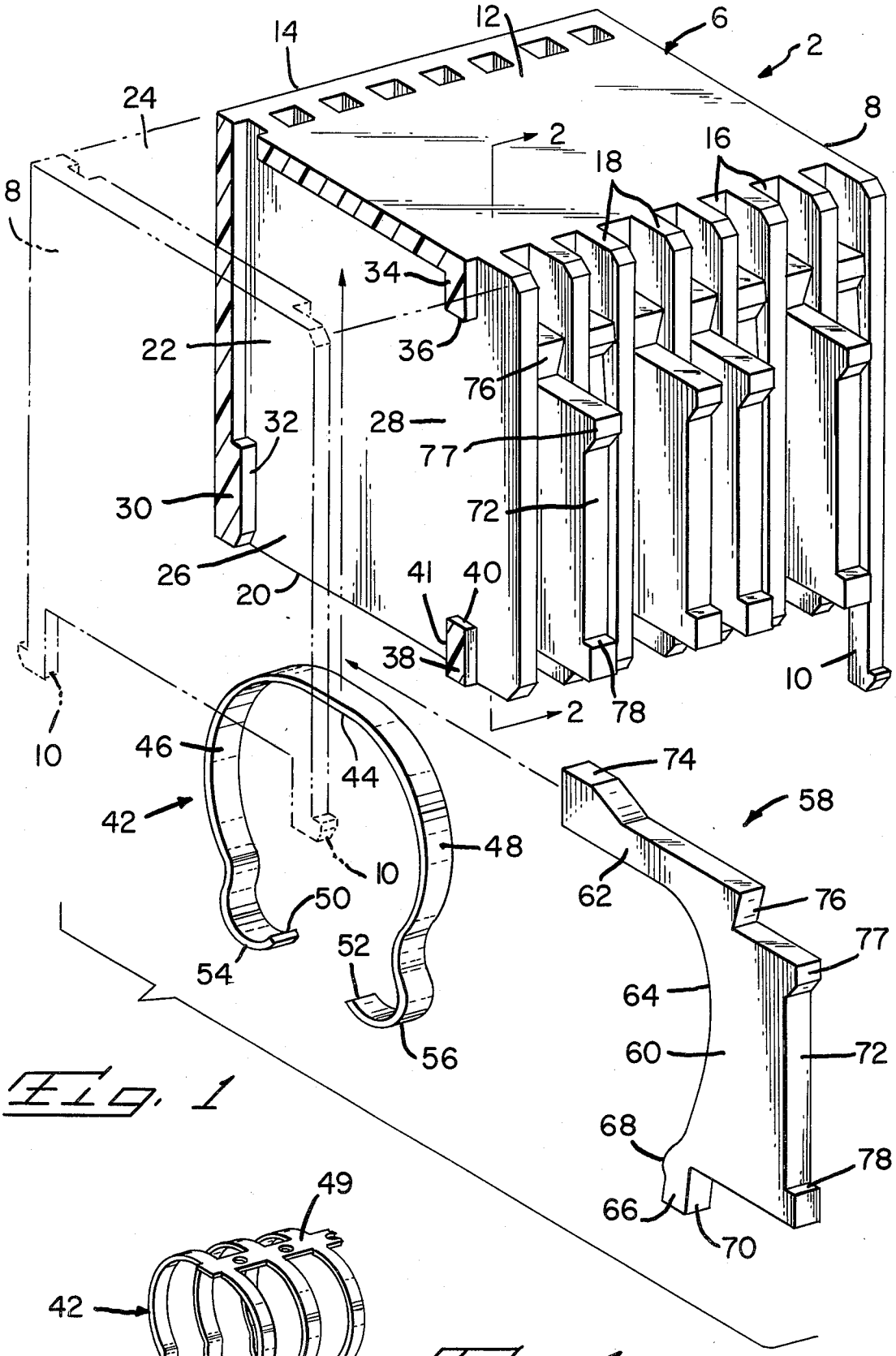
FIG. 1 is a perspective view of a switch module with parts exploded from each other.
Figure 2:
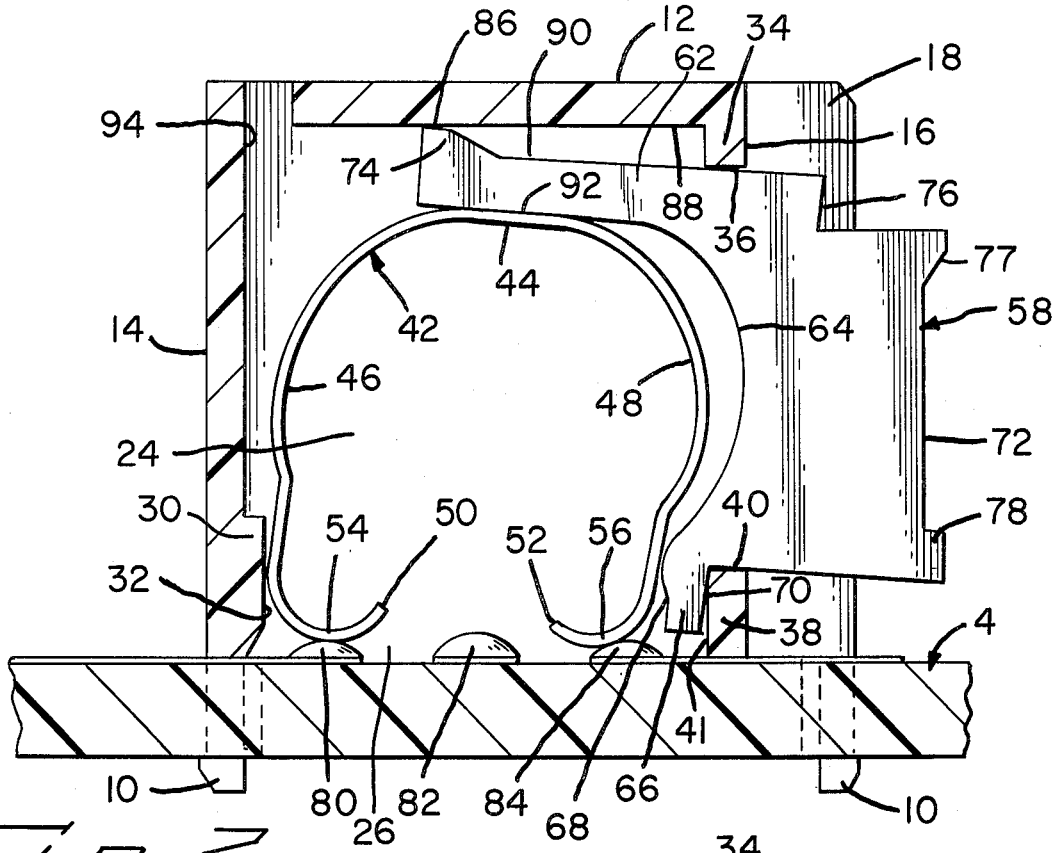
FIG. 2 is a sectional side view taken along the lines 2—2 of FIG. 1 showing the actuator in its extended position.
Figure 3:
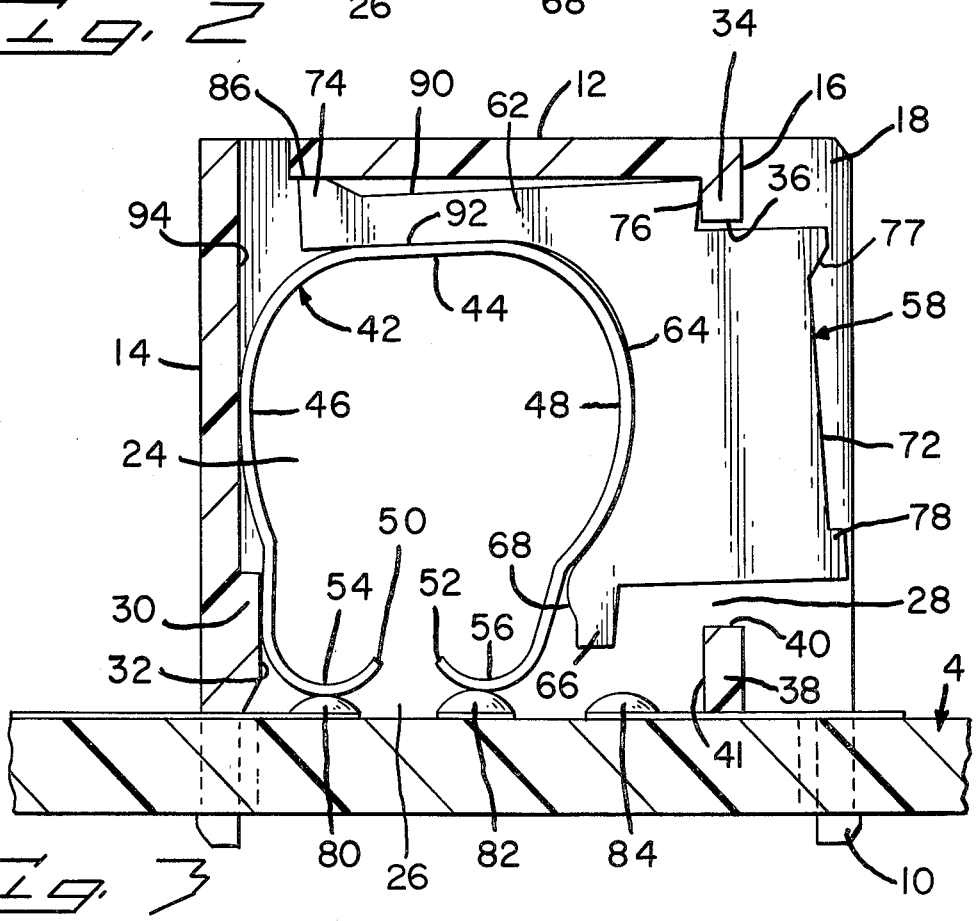
FIG. 3 is a view similar to FIG. 2 showing the actuator in its depressed position.

Referring to FIGS. 1, 2 and 3, a switch module 2, in accordance with one embodiment of the invention, is intended for mounting on the circuit board 4. The assembled switch module comprises a housing 6 having a plurality of switch cavities 24 therein, each switch cavity having an essentially U-shaped spring contact member 42 and an actuator member 58 therein.

The housing formed of a suitable insulating material, has oppositely facing external endwalls 8, mounting feet 10 integral with the endwalls, an external top wall 12, an external rear sidewall 14, an oppositely facing external front sidewall 16 having extension barriers 18 between each switch cavity 24, a base 20, and a plurality of internal barrier walls 22 parallel with the endwalls which define a plurality of switch cavities 24 within the housing. The base 20 has a first opening 26 into each switch cavity. The front sidewall 16 has a second opening 28 into each switch cavity. The shape of each switch cavity is further defined by an upward facing contact restraining means 30 integral with the rear sidewall 14, a first downward facing stopping means 34 integral with the front sidewall 16, and an upward facing second stopping means 38 integral with the front sidewall 16. The inner edges 32 and 41 of spring restraining means 30 and second stopping means 38 define the limits of the base opening 26 into the switch cavity. The lower edge 36 of stopping means 34 and the upper edge 40 of stopping means 38 define the limits of the front opening 28 into the switch cavity.

Each switch cavity has therein an essentially U-shaped formed spring contact member 42 having uppermost an essentially flat intermediate web portion 44, arcuate side 46 that extends from the web and bears against the contact restraining means 30, and arcuate side 48 which extends from the web and bears against the actuator member 38. The arcuate sides have spaced-apart ends 50 and 52 having switch contacts 54 and 56 thereon proximate to the base opening 26 in the switch cavity.

Each switch cavity further has therein a flat insulating actuator member 58 that is confined against lateral movement. The actuator is comprised of a body 60 having a contact restraining arm 62 at the upper left of the body, as viewed in FIG. 1, an arcuate contact restraining side 64 extending along the lower edge of the arm 62 and the left side of the body 60 culminating in a restraining and stopping leg 66 at the lower left edge of the body, and a force engaging side 72 that is opposite the arcuate side 64. The contact restraining arm 62 has a positioning protrusion 74 extended upwardly at its left-most end and an engaging shoulder 76 at the opposite end of the arm that cooperates with the first stopping means 34 in the cavity. The leg 66 has a side 68 that restrains the switch contact 56 and an opposite side 70 that cooperates with the second stopping means 38 in the housing. The force engaging side 72 has an engaging extension 77 at its upper edge and a releasing extension 78 at its lower edge.

Figure 4:
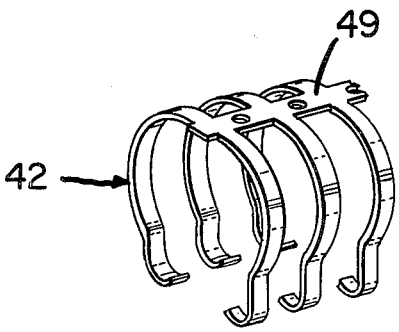
FIG. 4 is a perspective view of a strip of spring contact members.

A switch is assembled by first inserting the actuator into the base opening 26 of the switch cavity 24 and rotating the actuator into position so that the force engaging side 72 extends through the front sidewall opening 28 of the switch cavity. A spring contact member is cut from a strip 49, FIG. 4, flexed inwardly and inserted into the base opening 26 of the switch cavity with the switch contacts 54 and 56 proximate to the base opening 26. The unit is then mounted on a circuit board 4 having three contact points 80, 82, and 84 located within the area of the opening 26 into the base 20 of the switch cavity 24.

As shown in FIG. 2, when the mounted switch is in its first position, both the force engaging side 72 of the actuator 58 and the engaging shoulder 76 on the contact restraining arm 62 of the actuator extend through the opening 28 in the front sidewall 16. The actuator is stopped from extending further by the cooperation by the second stopping means 38 on the front sidewall 16 of the switch cavity 24 and the stopping side 70 of the restraining and stopping leg 66 of the actuator. The upper surface 86 of the positioning protrusion 74 on the contact restraining arm bears against the interior surface 88 of the topwall 12 of the switch cavity. The upper surface 90 of the contact restraining arm 62 bears against the upper limit 36 of the front opening 28. Side 46 of the spring contact member 42 bears against the restraining means 30 on the rear sidewall 14 of the switch cavity, web portion 44 bears against the lower surface 92 of the contact restraining arm 62 and side 48 of the spring contact member 42 bears against restraining side 68 of the restraining and stopping leg 66. When the switch is in its first position, FIG. 2, contact switch 54 on spring contact side 46 is against circuit board contact point 80 and switch contact 56 on spring contact side 48 is against circuit board contact point 84.

The switch is moved to its second position as shown in FIG. 3, by applying external force to the force engaging side 72 of the actuator 58 directed generally inwardly until the engaging shoulder 76 is inside the cavity, and obliquely upwardly against the engaging extension 77 to lock the engaging shoulder 76 with the first stopping means 34, as viewed in FIGS. 2 and 3. The inward movement of the actuator forces the spring contact member 42 to move inwardly causing spring contact side 46 to bear against the inner surface 94 of the rear sidewall, spring contact side 48 to bear against the arcuate side 64 of the actuator and switch contact 56 on spring contact side 48 to move from circuit board contact point 84 to circuit board contact point 82. When the switch is in its second position of FIG. 3, the extension barriers 18 extend beyond the outermost edge of the depressed actuator 58 and protect the actuator from accidental disengagement by foreign objects.

The switch is returned to the first position by applying external force to the releasing extension 78 directed generally downwardly and inwardly as viewed in FIG. 3. A force so directed will cause the actuator 58 to be displaced downwardly and leftwardly so that the engaging shoulder 76 will be disengaged from the first stopping means 34. When the force is removed after the downward displacement of the actuator, the actuator will be returned to the position of FIG. 2 under the influence of the spring contact member which pushes the actuator rightwardly as switch contact 56 on spring contact side 48 moves from circuit board contact point 82 to circuit board contact point 84.

A variety of types of switches can be made in accordance with the invention. The compact size of the preferred module permits a large number of switching devices in a relatively small area. In an eight switch array in the preferred single pole double throw embodiment, the external housing dimensions are 1.07 cm by 1.07 cm by 0.94 cm high, with the switches on 0.127 cm centerlines.

Figure 5:
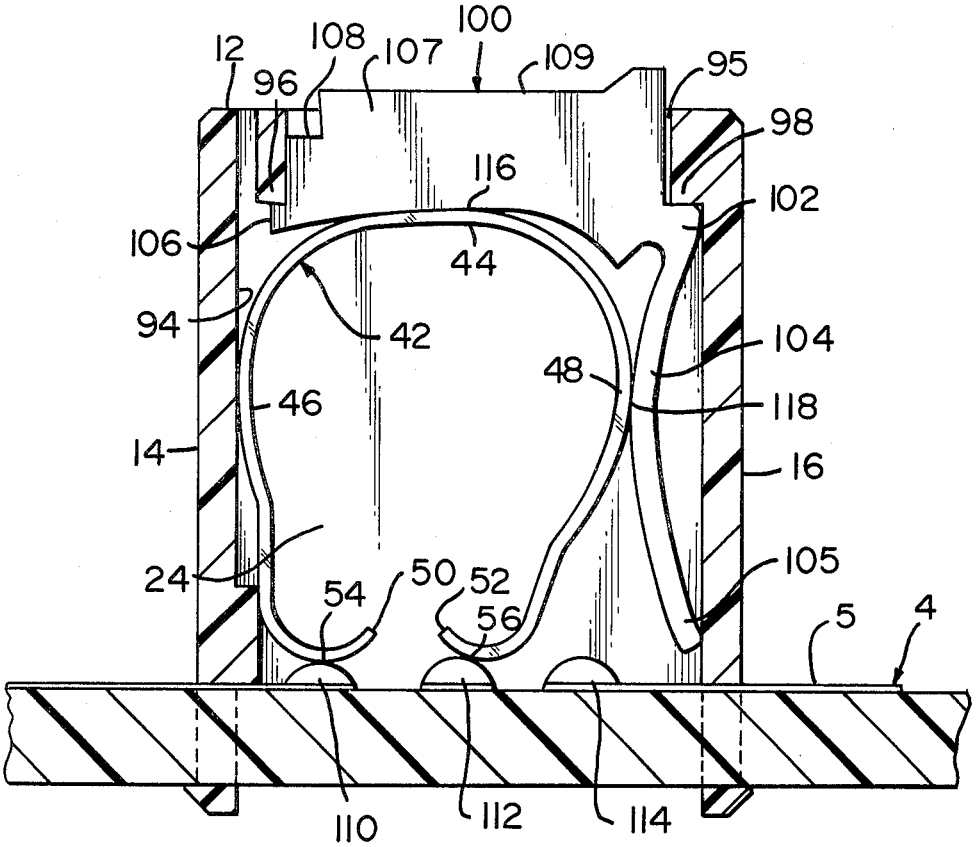
FIG. 5 is a sectional view of an alternative embodiment having the opening to the switch cavity in the top wall and the actuator in its extended position.
Figure 6:
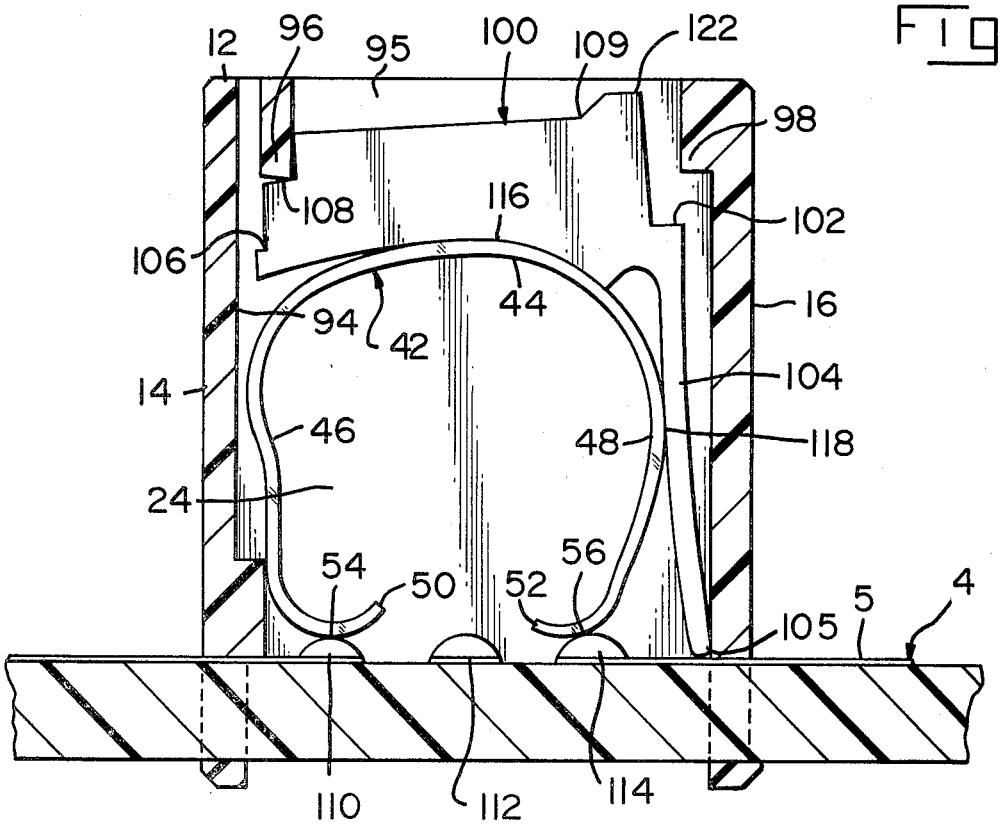
FIG. 6 is a view similar to FIG. 5 showing the actuator in its depressed position.

FIGS. 5 and 6 show another embodiment of the invention in which the second opening 95 into the switcopening 95 and a second stopping means 98 at the right side of the opening 95. The actuator 100 has a first stopping shoulder 102 at the upper end of the contact restraining arm 104 that engages with the second stopping means 98, a second stopping shoulder 106 at the opposite end of the actuator body 107 that engages with the first stopping means 96, and an engaging shoulder 108 at the left side of the actuator body 107. The engaging shoulder 108 engages with the first stopping means 96 when the actuator is in its depressed position as viewed in FIG. 6. In the first switch position, FIG. 5, the actuator is extended through the opening 95, switch contact 54 is against circuit board contact point 110 and switch contact 56 is against circuit board contact point 112. Spring contact side 46 bears against the inner surface 94 of the rear sidewall 14, web 44 bears against the contact restraining surface 116 of the actuator and spring contact side 48 bears against the inner surface 118 of the actuator arm 104.

The switch is moved to its second position by applying force to the force engaging side 109 of the actuator 100 directed generally downwardly and obliquely leftwardly as viewed in FIG. 5, until the engaging shoulder 108 is inside the switch cavity and is engaged with the first stopping means 96. During the downward movement of the actuator, from the position of FIG. 5 to the position of FIG. 6, the end 105 of contact restraining arm 104 moves against the surface 5 of the circuit board 4 so that the entire actuator 100 pivots in an anti-clockwise direction about the end 105 of contact restraining arm 104. As a result, the shoulder 108 is displaced leftwardly until it is beneath the stopping means 96. The downward movement of the actuator causes the spring contact member 42 to flex and spread so that spring contact side 48 of the spring contact member moves outwardly until switch contact 56 on spring contact side 48 bears against circuit board contact point 114, as viewed in FIG. 6.

The switch is returned to the first position of FIG. 5, by applying a force to the actuator directed generally downwardly and obliquely rightwardly, as viewed in FIG. 6. A force so directed will cause the actuator to be displaced rightwardly so that the shoulder 108 will be disengaged from the stop 96. When the force is removed after the rightward displacement of the actuator, the actuator will be returned to the position of FIG. 5 under the influence of the spring contact member which pushes the actuator upwardly. The upward movement of the spring contact member 42 causes spring contact side 48 to move inwardly until switch contact 56 again bears against circuit board contact point 112, as viewed in FIG. 5.

Figure 7:
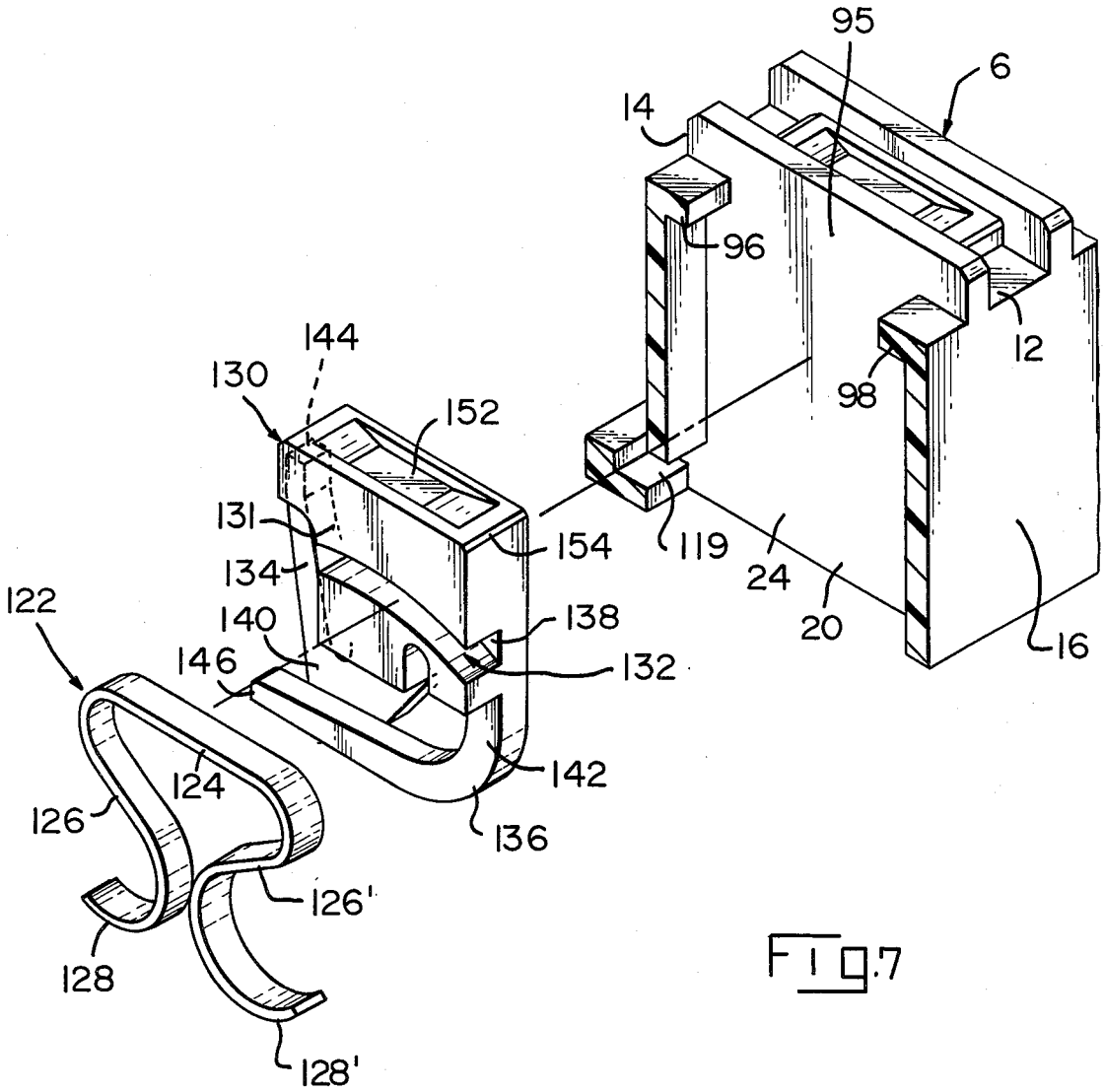
FIG. 7 is a perspective view of a further alternate embodiment with parts exploded from each other.
Figure 8:
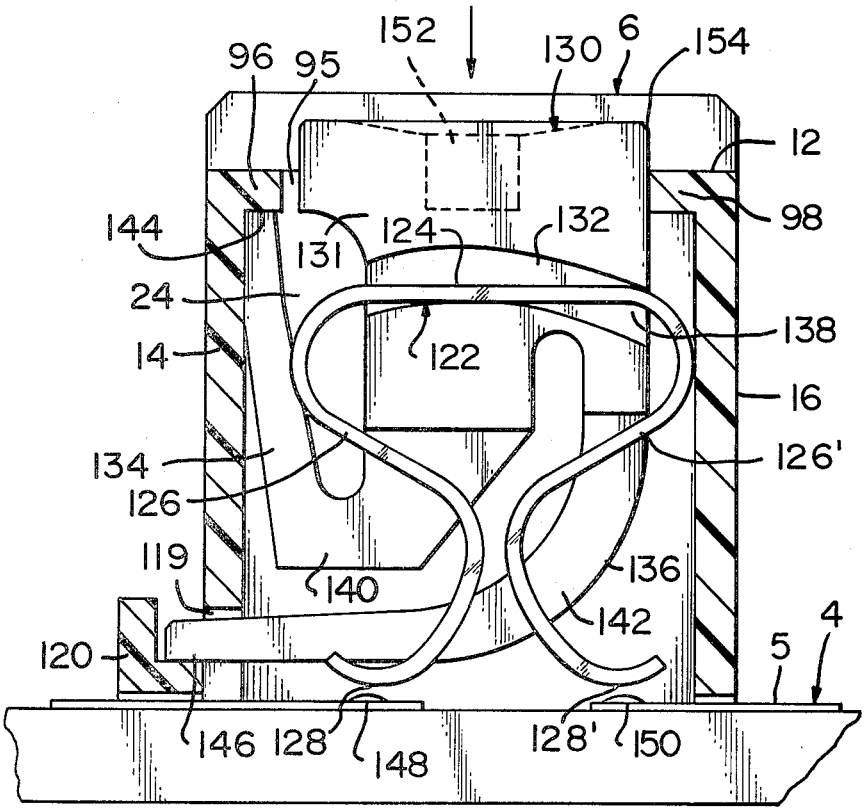
FIG. 8 is a sectional side view of the above alternate embodiment with its spring contact member being stamped and formed from sheet metal and having the actuator in its extended position.

FIGS. 7 and 8 show another alternate embodiment of the invention with the second opening 95 into the switch cavity 24 in the top wall 12. In this embodiment, there is a third opening 119 into the switch cavity 24 at the lower end of the rear sidewall 14 and the base 20 of the housing 6 has an actuator restraining extension means 120 along the lower external edge of the rear sidewall 14. An essentially U-shaped spring contact member 122 having a web 124 and inwardly formed sides 126 and 126' with switch contacts 128 and 128' thereon, is stamped and formed from sheet metal. The actuator 130 has a body 131, approximately twice the width of the spring contact member, having a recess 132 therein for holding a portion of the spring contact member 122. Integral with the lower left of the body 131, as viewed in FIGS. 7 and 8, is an upper leg 134 that extends laterally to the left and upwardly until its upper end 144 engages with the first stopping means 96, as viewed in FIG. 8. Integral with the lower right of the body 131, as viewed in FIGS. 7 and 8, is a lower leg 136 that extends first downwardly and then curves leftwardly with its end 146 projecting through rear side opening 119 and is engaged with the actuator restraining extension 120. The legs 134 and 136 are narrower in width than the body 131 of the actuator 130 to permit the spring contact member 122 to rest against the rear surface 138 of the recess 132 and the front surfaces 140 and 142 of the upper and lower legs 134 and 136, thus preventing the rotation of the spring contact member in the switch cavity.

The switch in this embodiment is mounted on a circuit board having two circuit board contact points 148 and 150 in the area under the switch cavity 24. When the switch is in its first position, the switch contacts 128 and 128' on the spring contact member 122 are above the circuit board contact points. The switch is actuated by applying an external force to the top 152 of the actuator generally downwardly and rightwardly, as viewed in FIG. 8, until the right hand engaging corner 154 of the actuator engages with the second stopping means 98 on the top wall 12 of the switch cavity 24. The resulting movement forces switch contacts 128 and 128' on spring contact member 122 to bear against the circuit board contact points 148 and 150.

The switch is returned to its first position by applying force to the top 152 of the actuator generally downwardly and obliquely leftwardly. A force so directed will cause the actuator to be displaced leftwardly so that the right hand engaging shoulder 154 of the actuator will be disengaged from the second stopping means 98. When the force is removed after the leftward displacement of the actuator, the actuator will be returned to the position of FIG. 8 by the influence of the spring contact member 122. Switch contacts 128 and 128' on the spring contact member 122 will again be above the circuit board contact points 148 and 150.

Figure 9:
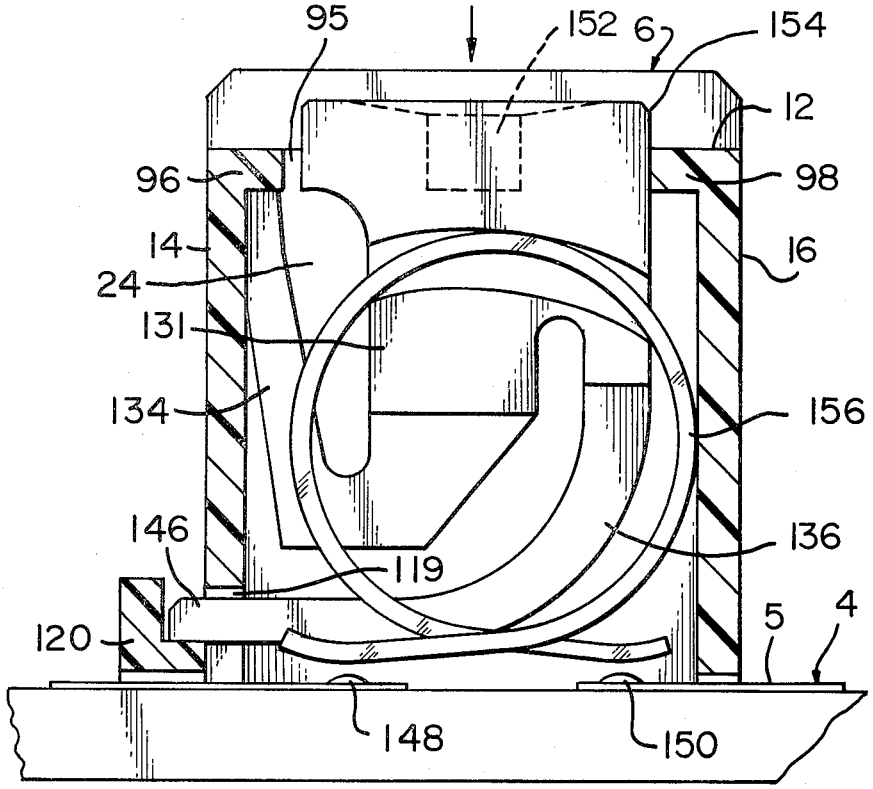
FIG. 9 is a sectional side view of the above alternate embodiment with its spring contact member being a coil wire and having the actuator in its extended position.

FIG. 9 shows essentially the same switch embodiment as FIGS. 7 and 8, except that the switch contact member is a coiled wire 156.

What is claimed is:

1. A switch which is intended for mounting on a circuit board, the switch comprising a prismatic insulating housing having oppositely facing external endwalls, an external topwall, oppositely facing external sidewalls extending between the endwalls, and a base, at least one switch cavity in the housing, the cavity having a switch contact and an actuator therein, the switch being characterized in that:

the cavity has a first opening at the base of the housing and a second opening in one of the external walls other than the endwalls, the cavity has an elongated circuitiously formed spring therein, the spring having spaced-apart ends which are proximate to the first opening, the ends having switch contacts thereon, at least one of the ends being movable upon the application and removal of a flexing force to an intermediate portion of the spring, the actuator being movably contained in the cavity and being in engagement with the intermediate portion of the spring, the actuator having an engageable portion which projects through the second opening in the housing which can be engaged by an externally applied force to push the actuator into the associated cavity, the actuator being normally in a first position in which the engageable portion projects through the second opening to an extended position, the actuator being movable inwardly of the cavity to a depressed position upon application of an external force to the engageable portion with accompanying application of a flexing force to the intermediate portion of the spring whereby, the switch can be mounted on a circuit board with the switch contacts associated with a pair of circuit board contacts and with the switch contacts against the circuit board contacts when the actuator is in one of its positions, at least one of the switch contacts being spaced from its associated circuit board contact when the actuator is moved to its other position.

2. A switch as set forth in claim 1 characterized in that the actuator is biased to its first position by the spring, the actuator and the housing having opposed stop shoulder surfaces which restrain the actuator from further movement through the second opening of the housing under the influence of the spring.

3. A switch as set forth in claim 2 characterized in that a detent is provided to retain the actuator in the depressed position, the detent being a shoulder on the actuator and a detent shoulder on the housing.

4. A switch as set forth in claim 3 characterized in that the spring is substantially U-shaped, one leg of the spring being in engagement with the actuator and constituting the intermediate portion.

5. A switch as set forth in either of claims 1 or 4 characterized in that the second opening to each cavity is in one of the housing sidewalls.

6. A switch as set forth in either of claims 1 or 4 characterized in that the second opening to each cavity is in the housing topwall.

7. A switch as set forth in claim 5 characterized in that the housing has a plurality of side-by-side parallel aligned cavities therein, each of the cavities having a spring and an actuator therein, the housing, cavities, springs, and actuators forming a switch module containing a plurality of individual switches.

8. A switch as set forth in claim 7 characterized in that the housing has mounting feet extending from the base thereof for mounting the switch on one surface of a circuit board in covering relationship to the circuit board contacts.

9. A switch as set forth in claim 4, the spring and the actuator being of substantially the same thickness and being coplanar, the actuator being in partially surrounding relationship to the spring, the cavity having a width which is sufficient to receive the spring and the actuator and permit sliding movement of the actuator between the first position and the depressed position.

10. A switch as set forth in claim 3 characterized in that the actuator has a recess extending therethrough, portions of the spring being received in the recess.

11. A switch as set forth in claim 10, the spring being a formed wire.

12. A switch as set forth in either of claims 1 or 3, characterized in that the spring is a stamped and formed sheet metal member.

* * * * *